US007456734B2

(12) United States Patent
Lenshin et al.

(10) Patent No.: US 7,456,734 B2
(45) Date of Patent: Nov. 25, 2008

(54) SECURITY ALARM DEVICE

(75) Inventors: Vitaly Petrovich Lenshin, Moscow (RU); Sergey Georgievich Rikhter, Moscow (RU)

(73) Assignee: Zakritoe Aktsionernoe Obschestvo "Kasiss", Moscow (RU)

( * ) Notice: Subject to any disclaimer, the term of this patent is extended or adjusted under 35 U.S.C. 154(b) by 158 days.

(21) Appl. No.: 10/547,008

(22) PCT Filed: Feb. 25, 2004

(86) PCT No.: PCT/RU2004/000062

§ 371 (c)(1),
(2), (4) Date: Aug. 25, 2005

(87) PCT Pub. No.: WO2004/077375

PCT Pub. Date: Sep. 10, 2004

(65) Prior Publication Data

US 2006/0170552 A1 Aug. 3, 2006

(30) Foreign Application Priority Data

Feb. 27, 2003 (RU) ..... 2003105521

(51) Int. Cl.
*G08B 1/08* (2006.01)

(52) U.S. Cl. ..... 340/539.11; 340/539.1; 340/539.15; 340/539.21; 340/539.23; 340/506; 340/517; 340/571

(58) Field of Classification Search ..... 340/572.1, 340/531, 541, 539.1, 539.14, 539.16, 539.17, 340/545.1, 845.49, 539.13, 539.21, 539.23, 340/517, 521, 568.1, 539.11, 539.15, 506, 340/51, 7, 540, 571, 825.69, 825.72
See application file for complete search history.

(56) References Cited

U.S. PATENT DOCUMENTS

| | | | | |
|---|---|---|---|---|
| 4,051,472 | A * | 9/1977 | Albanese et al. | 342/28 |
| 4,605,922 | A * | 8/1986 | Blattman et al. | 340/552 |
| 4,952,939 | A * | 8/1990 | Seed | 342/27 |
| 6,122,312 | A * | 9/2000 | Shiro | 375/147 |
| 6,909,095 | B2 * | 6/2005 | Tran et al. | 250/341.1 |
| 7,023,341 | B2 * | 4/2006 | Stilp | 340/572.1 |
| 7,170,404 | B2 * | 1/2007 | Albert et al. | 340/521 |

* cited by examiner

*Primary Examiner*—Hung T. Nguyen
(74) *Attorney, Agent, or Firm*—Thomas, Kayden, Horstemeyer & Risley LLP

(57) ABSTRACT

The device is designed for warning about relocation of objects under control relative to the controlling user. The engineering effect is achieved through the ability to carry out control and identification of several objects at a time and to generate preliminary warning about possible loss of contact with objects under control. The device uses a pseudo-noise signal and makes it possible to differentiate between signals within the same bandwidth and the same time interval through the form-wise selection. i.e. the device solves the problem of carrier guidance in terms of frequency, virtually eliminating the cross-talk and interference with other radio systems and provides ample opportunities for increase in the number of simultaneously controlled (guarded) objects by means of, for example, modifications in the structure of a pseudo-random sequence for pseudo-noise signal generation.

1 Claim, 1 Drawing Sheet

SECURITY ALARM DEVICE

The invention relates to security alarm devices and can be used for warning about controlled objects repositioning relative to any user controlling them.

BACKGROUND ART

The known security alarm device based on noise-like signals (NLS) consists of transmitting unit arranged on each guarded object, comprising a serially arranged unauthorized access sensor, an encoder, an operational radiosignal conditioner, a power amplifier and a transmitting antenna, a receiving unit which is arranged in a user and comprises a receiving antenna, an input filtering and matching chain, a bandpass amplifier, a unit for optimal processing a noise-like signal on acoustic surface waves and an alarm unit, wherein the transmitting unit and the receiving unit have the same signal-carrier frequency [RF patent No 2103742, G08B13/10, pubd. 27.01.98, bul. No 3]. This device is the most closely related to the offered one by its technical essence. Said known device has limited capabilities due to the following imperfections:

it does not possess the threshold properties providing an alarm actuation when user moves away at a fixed distance from an object which he controls;

it does not provide a simultaneous control of N guarded objects and their identification;

it does not provide a function of preliminary warning of possible contact loss with controlled objects.

DISCLOSURE OF THE INVENTION

The object of the present invention is to produce an alarm (warning) signal at mutual distancing of user and controlled objects at a fixed distance, to provide a simultaneous control of several objects and their identification, and preliminary warning of possible contact loss with controlled objects that should contribute to objects safety or their protection against any encroachments of the third persons.

The invention satisfy the above object by the following: the security alarm device is based on noise-like signals and consists of a transmitting unit which is arranged on each guarded object and comprises a serially arranged pseudorandom sequence (PRS) generator, a noise radiosignal conditioner, power amplifier and a transmitting antenna, a receiving unit which is arranged in a user and comprises a receiving antenna, an input filtering and matching chain, a bandpass amplifier, unit for optimal processing a noise-like signal on acoustic surface waves, a release device and an alarm unit, wherein the transmitting unit and the receiving unit have the same signal-carrier frequency. The receiving unit comprises N in-parallel units for optimal processing the noise-like signal on the acoustic surface waves, a commutator having N signal inputs, N signal outputs and a control input, a control system for the commutator provided with two inputs and two outputs one of which is connected to the control input of the commutator, a dual-threshold decision system provided with N inputs and two outputs, wherein each of N signal outputs of the commutator is connected to one of N inputs of the dual-threshold decision system whose one output is connected to the input of the release device, the second output thereof being connected to one of the inputs of the control system for the commutator. The alarm unit further comprises a liquid-crystal display, the output of the release device is connected to the input of an alarm device and to the second input of the control system for the commutator, the second output thereof being connected to the input of the liquid-crystal display.

BRIEF DESCRIPTION OF THE DRAWINGS

The invention is explained below by the detailed description of the inventive security alarm device with the reference to the accompanying drawing in which.

BEST MODE OF CARRYING OUT THE INVENTION

Figure 1:
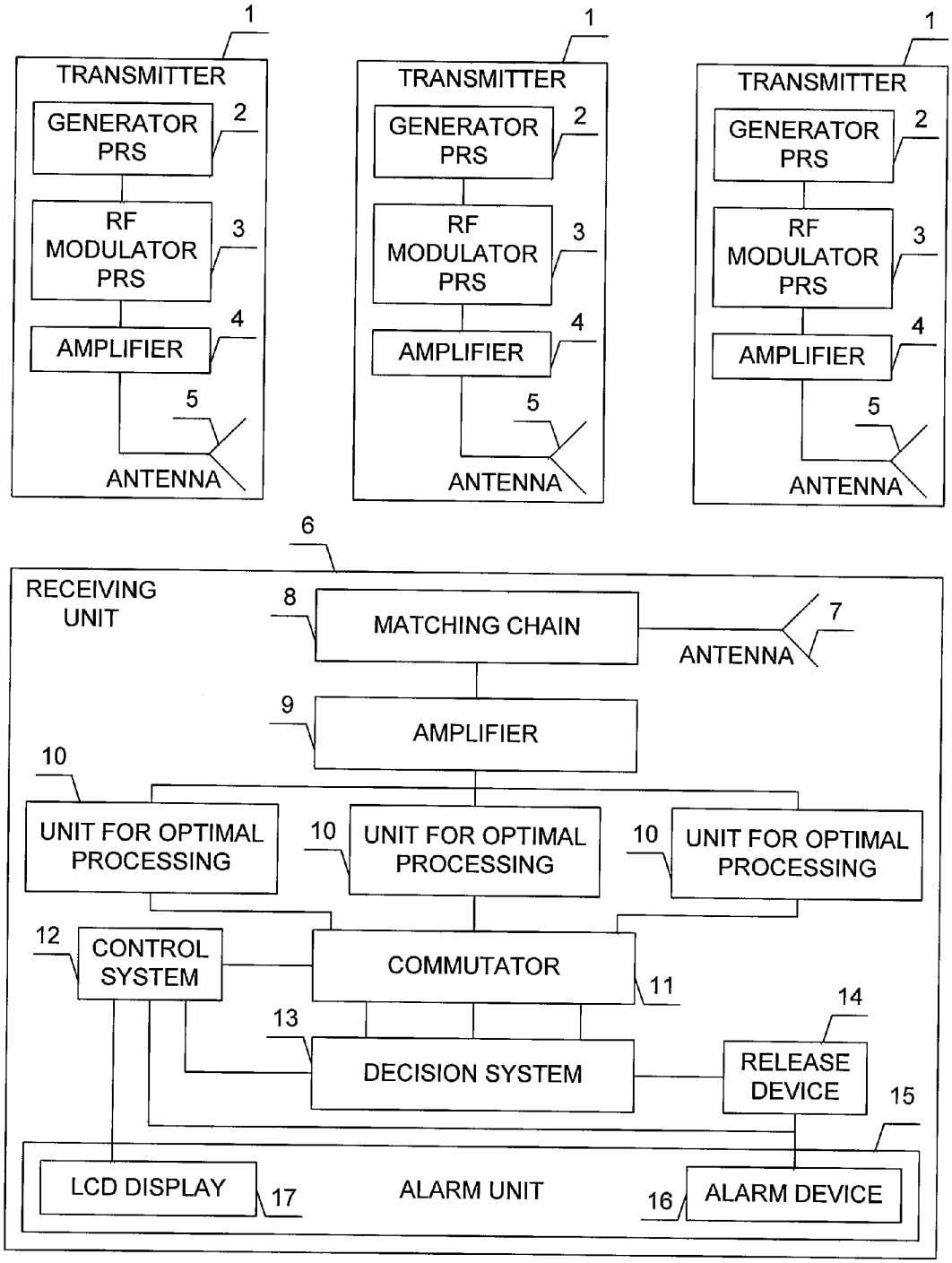
FIG. 1 represents schematically the security alarm device.

On each of N objects which position is supposed to be controlled, the transmitting unit 1 is arranged. The PRS signal formed by the pseudorandom sequence generator 2, is transmitted to noise radiosignal conditioner 3, where keying of harmonic wave (oscillation) phase of carrier frequency f is performed. The waves are received from the quartz generator which is the part of the conditioner 3. The radiosignal is transmitted to the power amplifier 4. The amplified phase-shift keyed radiosignal is transmitted by the transmitting antenna 5.

Signals of the transmitting units 1 arranged on the controlled objects are received by the receiving unit 6, which is in monitoring person's use. The receiving unit comprises the receiving antenna 7, the input filtering and matching chain 8, the bandpass amplifier 9, N (according to the number of controlled objects) units 10 for optimal processing NLS on acoustic surface waves (ASW), the commutator 11 with the control system 12 for the commutator 11, the dual-threshold decision system 13, the release device 14 and the alarm unit 15 with audible and/or vibrational alarm device 16 and indicator—the liquid-crystal display 17.

NLS use in the inventive device allows to isolate those signals which are transmitted in the same frequency band and in the same periods by having applied separation of signals according to their waveform, i.e. it solves a problem of radio channel frequency multiplexing, having practically eliminate the effect of interference of such devices and their impact to other radio systems, providing the wide performance capabilities in the field of increasing the number of objects controlled (guarded) simultaneously. For example, variation of pseudorandom sequence (PRS) structure during the NLS forming (modulating) allows to achieve a high spectral (frequency) efficiency of the security alarm device intended for warning in case of simultaneous repositioning of several controlled objects, as all the guarded objects are provided with transmitting units working on the same frequency and comprising the PRS generators with individual sequence structure preset during transmitter manufacturing. The most common and well investigated PRS are m-sequences (i.e. the sequences of the maximal shift register length). The length of these sequences is $m=2^k-1$, where k is any whole positive number greater than 1. In practice, in order to obtain m-sequences the binary shift register is used which contains k triggers serially arranged that are able to change their state to an opposite one at the time determined by the clock generator. For example, the structure of sequence can be 15-bit (if m=15, and k=4) The radio system of the security alarm device works as follows.

When the system is switched into an operational state the radio-transmitting units 1 arranged on the controlled objects, begin to transmit periodically during the time period (t=1 . . . 3 s) the phase-shift keyed radiosignal with pseudorandom coding. The individual structure of m-sequence coding which is an identification feature of a specific controlled object is incorporated into the PRS generator 2. The pseudorandom binary signal of generator 2 is transmitted to the noise-like phase-shift keyed radiosignal conditioner 3 where the harmonic wave of carrier frequency f is keyed with the PRS-sequence. The carrier frequency highly stable wave is received from the quartz self-excited generator which is a part of the conditioner. The carrying wave (oscillation) phase-shift keyed according to PRS rule is amplified by the power amplifier 4 and transmitted by the transmitting antenna 5.

At the receiving unit 6 with preset operating frequency of transmitters f the phase-shift keyed radiosignals through the receiving antenna 7, the input filtering and matching chain 8 and the bandpass amplifier 9 are supplied to the units 10 for optimal processing noise-like signal on acoustic surface waves. The PRS is processed by N units (according to the number of controlled objects) performing the optimal signal procession (time compression). As a result, at the moment of NLS ending a correlation voltage peak appears at the output. Owing to the commutator 11, which is cyclically switched by the control system 12 for the commutator 11, the output signal of the processing unit 10 is supplied to the input of the dual-threshold decision system 13. The dual-threshold decision system 13 controls the U voltage in each branch, comparing it with threshold values $U_1$ and $U_2$. At decreasing of voltage $U_k$ owing, for example, to attenuation of the k-th transmitter's signal for any reason, if the condition $Uk=U_1$ is met, then the dual-threshold decision system 13 supplies a preliminary alarm signal to the control system 12 and the release device 14, actuating the alarm unit 15, namely results in periodic triggering of the alarm device 16. On the other hand, an appearance of signal at the output of the dual-threshold decision system 13 is unequivocally related with specific position of the commutator 11 controlled by the system 12, therefore, simultaneously with alarm system actuation, information concerning position of commutator is sent from the system 12 to the indicator—the liquid-crystal display 17.

If an alarm reason is not eliminated and voltage $U_k$ in the k-th processing branch continues to decrease and also the condition $U_k=U_2$ is met, then the system 13 produces a final alarm signal which actuates the alarm unit 15 in a constant mode with preservation of indication of k number at the liquid-crystal display (LCD) 17.

Thus, if a user who has a receiving unit 6 moves away from any of controlled objects at the distance set by the user during a preliminary adjustment (regulation) of the radio-frequency radiation power level of transmitting units, the sound and/or vibrational alarm device 16 actuates, and an identification image (number or schematic image) of that object the contact with which has been lost appears on the screen of liquid-crystal display 17.

A selective function of security alarm radio system providing an identification of each of the controlled object is realized owing to optimal processing NLS by the processing unit 10. In case of implementation of this unit on acoustic surface waves (ASW) a NLS supply to its input with signal structure (i.e. PRS rule) matched with ASW structure will result in appearance at the output of correlation voltage peak comprising up to 90% of the input signal energy. Therefore the presence of ASW-structures matched with the PRS structure of specific transmitter in each of N parallel chains—processing units 10 allows to provide an identification of the object on which this transmitter is located.

Available radioelements whose technical requirements do not surpass the capabilities of modern microcircuit technique can be used for practical implementation of the offered security alarm radio system which actuates at repositioning of the controlled objects. Practically each element of the radio system is the standard one, eligible for microminiaturization and widely applied in common transceivers. The technology of NLS processing units at ASW is compatible with an integrated circuit production technique which allows to ensure the identity of units characteristics at replication and excludes the necessity of their adjustment during manufacturing.

Security functions of the radio system with respect to specific object are realized by selection of the object transmitter power level and the actuation level of radioreceiver threshold circuit in such a way that mutual distancing of the radio transmitter and the radioreceiver for a distance specified by the user results in actuation of the sound and/or vibrational alarm system of the radioreceiver.

INDUSTRIAL APPLICABILITY

Implementation of this device will allow to warn the user in proper time about the possible loss (or theft) of controlled objects, for example, personal valuables, including those of a rather small size.

The invention claims:

1. A portable security alarm device based on pseudo-noise signals consists of a portable transmitting unit arranged on each of N guarded objects, each portable transmitting unit comprises
- a serially arranged pseudorandom sequence generator,
- a noise radiosignal conditioner configured to form a pseudo-noise signal,
- a power amplifier,
- a transmitting antenna, a receiving unit which is arranged with a user and comprises
- a receiving antenna,
- an input filtering and matching chain,
- a bandpass amplifier,
- a unit for optimal processing the pseudo-noise signal on acoustic surface waves, the pseudo-noise signal identifying the transmitting unit,
- a release device and
- an alarm unit, wherein the portable transmitting unit has a signal-carrier frequency and the receiving unit has the same signal-carrier frequency, characterized in that said receiving unit comprises
- N in-parallel units for optimal processing the pseudo-noise signal on the acoustic surface waves,
- a commutator having N signal inputs, N signal outputs and a control input,
- a control system for the commutator provided with two inputs and two outputs one of which is connected to the control input of the commutator,
- a dual-threshold decision system provided with N inputs and two outputs, each of N signal outputs of the commutator is connected to one of N inputs of the dual-threshold decision system whose one output is connected to the input of the release device, the second output thereof being connected to one of the inputs of the control system for the commutator,
- the alarm unit further comprises a liquid-crystal display and an alarm device, the output of the release device is connected to an input of the alarm device and to the second input of the control system for the commutator, the second output of the control system being connected to an input of the liquid-crystal display.

* * * * *